US008756761B2

(12) United States Patent
Barquet et al.

(10) Patent No.: US 8,756,761 B2
(45) Date of Patent: Jun. 24, 2014

(54) HINGE AND METHOD OF ASSEMBLING THE SAME

(75) Inventors: Oriol Agramont Barquet, Barcelona (ES); Jose Maria Mednez Segui, Palma de Mallorca (ES); Victor Lazaro Barranco, Terrassa (ES); Miguel Angel Perez Gandara, Barcelona (ES); Charl Du Plessis, Barcelona (ES)

(73) Assignee: UTC Fire & Security Americas Corporation, Inc., Bradenton, FL (US)

( * ) Notice: Subject to any disclaimer, the term of this patent is extended or adjusted under 35 U.S.C. 154(b) by 0 days.

(21) Appl. No.: 13/575,830

(22) PCT Filed: Jan. 27, 2011

(86) PCT No.: PCT/EP2011/000362

§ 371 (c)(1),
(2), (4) Date: Jul. 27, 2012

(87) PCT Pub. No.: WO2011/092013

PCT Pub. Date: Aug. 4, 2011

(65) Prior Publication Data

US 2012/0292335 A1 Nov. 22, 2012

(30) Foreign Application Priority Data

Jan. 28, 2010 (EP) ..... 10382015

(51) Int. Cl.
*E05D 7/10* (2006.01)

(52) U.S. Cl.
USPC ..... 16/262; 16/374; 16/386; 16/387

(58) Field of Classification Search
USPC ..... 16/262, 374, 379, 380, 386, 387, 388, 16/390, 381
See application file for complete search history.

(56) References Cited

U.S. PATENT DOCUMENTS

| | | | | | |
|---|---|---|---|---|---|
| 170,598 | A | * | 11/1875 | Shields | 16/380 |
| 353,007 | A | * | 11/1886 | Schubert et al. | 16/381 |
| 1,113,278 | A | * | 10/1914 | Zobel | 16/388 |
| 1,341,063 | A | * | 5/1920 | McQueen | 16/262 |
| 1,683,814 | A | * | 9/1928 | Block | 16/353 |
| 2,677,147 | A | | 5/1954 | Phillips et al. | |
| 2,803,850 | A | * | 8/1957 | Hooper | 16/341 |
| 2,886,830 | A | * | 5/1959 | Iaquinta | 5/2.1 |
| 4,482,023 | A | * | 11/1984 | Dziedzic et al. | 180/89.17 |
| 6,438,800 | B1 | * | 8/2002 | Narang et al. | 16/389 |
| 2002/0095744 | A1 | | 7/2002 | Narang et al. | |
| 2007/0136999 | A1 | * | 6/2007 | Huang | 16/387 |

FOREIGN PATENT DOCUMENTS

| | | |
|---|---|---|
| GB | 2264144 | 8/1993 |
| GB | 2316706 | 3/1998 |

* cited by examiner

*Primary Examiner* — Roberta Delisle
(74) *Attorney, Agent, or Firm* — Cantor Colburn LLP

(57) ABSTRACT

A hinge (100) including a first flange (102) having a first sleeve segment and a portioned sleeve segment is disclosed. The hinge also includes a second flange (104) having a second sleeve segment. The second flange is configured to mate with the first flange such that the first sleeve segment, the second sleeve segment, and the portioned sleeve segment are substantially aligned. A pin (106) is configured to be removably inserted into the first sleeve segment and the second sleeve segment. Also disclosed are a method for assembling a hinge and a container assembly including a hinge.

18 Claims, 8 Drawing Sheets

HINGE AND METHOD OF ASSEMBLING THE SAME

CROSS-REFERENCE TO RELATED APPLICATIONS

This application claims the benefit of, and is the U.S. national stage of International Application No. PCT/EP2011/000362 filed on 27 Jan. 2011, which claims the priority benefit of EPO Patent Appl. No. 10382015.5 filed on 28 Jan. 2010, both of which are incorporated by reference herein in their entirety.

BACKGROUND OF THE INVENTION

1. Field of the Invention

The embodiments described herein relate generally to a hinge and, more particularly, to a hinge and a method of assembling the hinge.

2. Description of Related Art

At least some known hinges include a first plate fastened to a first object (e.g., a cover), a second plate fastened to a second object (e.g., a container), and a link that is inserted into the first plate and the second plate such that at least one of the first object and the second object is pivotable relative to the other.

Because many known hinges have plates that are securely fastened (e.g., screwed, nailed, or bolted) to the objects and because the link between the plates can be difficult to insert and remove, assembling and disassembling the hinge (i.e., attaching and detaching the objects from one another) can be a time consuming and frustrating task. As such, it would be useful to provide a hinge that is easier to assemble and/or disassemble, thereby minimizing the time and frustration associated with attaching and/or detaching two hinged objects.

BRIEF SUMMARY OF THE INVENTION

In one aspect, a method for assembling a hinge includes mating a first flange including a first sleeve segment and a portioned sleeve segment with a second flange including a second sleeve segment such that the first sleeve segment, the second sleeve segment, and the portioned sleeve segment are substantially aligned. The method also includes removably inserting a pin into the first sleeve segment and the second sleeve segment.

In another aspect, a hinge includes a first flange including a first sleeve segment and a portioned sleeve segment. The hinge also includes a second flange including a second sleeve segment. The second flange is configured to mate with the first flange such that the first sleeve segment, the second sleeve segment, and the portioned sleeve segment are substantially aligned. A pin is configured to be removably inserted into the first sleeve segment and the second sleeve segment.

In yet another aspect, a container assembly includes a container, a cover for the container, and a hinge pivotably coupling the cover to the container. The hinge includes a first flange fastened to the container and a second flange fastened to the cover. The first flange includes a first sleeve segment and a portioned sleeve segment. The second flange includes a second sleeve segment. The second flange is configured to mate with the first flange such that the first sleeve segment, the second sleeve segment, and the portioned sleeve segment are substantially aligned. The hinge also includes a pin configured to be removably inserted into the first sleeve segment and the second sleeve segment.

The embodiments described herein produce a hinge that is more easily assembled and disassembled, thereby decreasing a time required for assembling and disassembling the hinge. More specifically, the embodiments described herein produce a hinge that enables objects to be more easily attached to and detached from one another, which reduces a time and/or a cost associated with replacement or maintenance of the hinged objects and/or the hinge.

BRIEF DESCRIPTION OF THE DRAWINGS

FIG. 1 is a perspective view of a hinge in an assembled and closed configuration;

FIG. 2 is another perspective view of the hinge shown in FIG. 1 in an assembled and closed configuration;

FIG. 3 is a perspective view of a first flange of the hinge shown in FIGS. 1 and 2;

FIG. 4 is a perspective view of a second flange of the hinge shown in FIGS. 1 and 2;

FIG. 5 is a perspective view of a pin of the hinge shown in FIGS. 1 and 2;

FIG. 6 is a perspective view of the hinge shown in FIGS. 1 and 2 in an open configuration and during a first or initial stage of assembly;

FIG. 7 is a perspective view of the hinge shown in FIGS. 1 and 2 in an open configuration and during a second stage of assembly; and FIG. 8 is a perspective view of the hinge shown in FIGS. 1 and 2 in an open configuration and during a third stage of assembly.

DETAILED DESCRIPTION OF THE INVENTION

Figure 6:
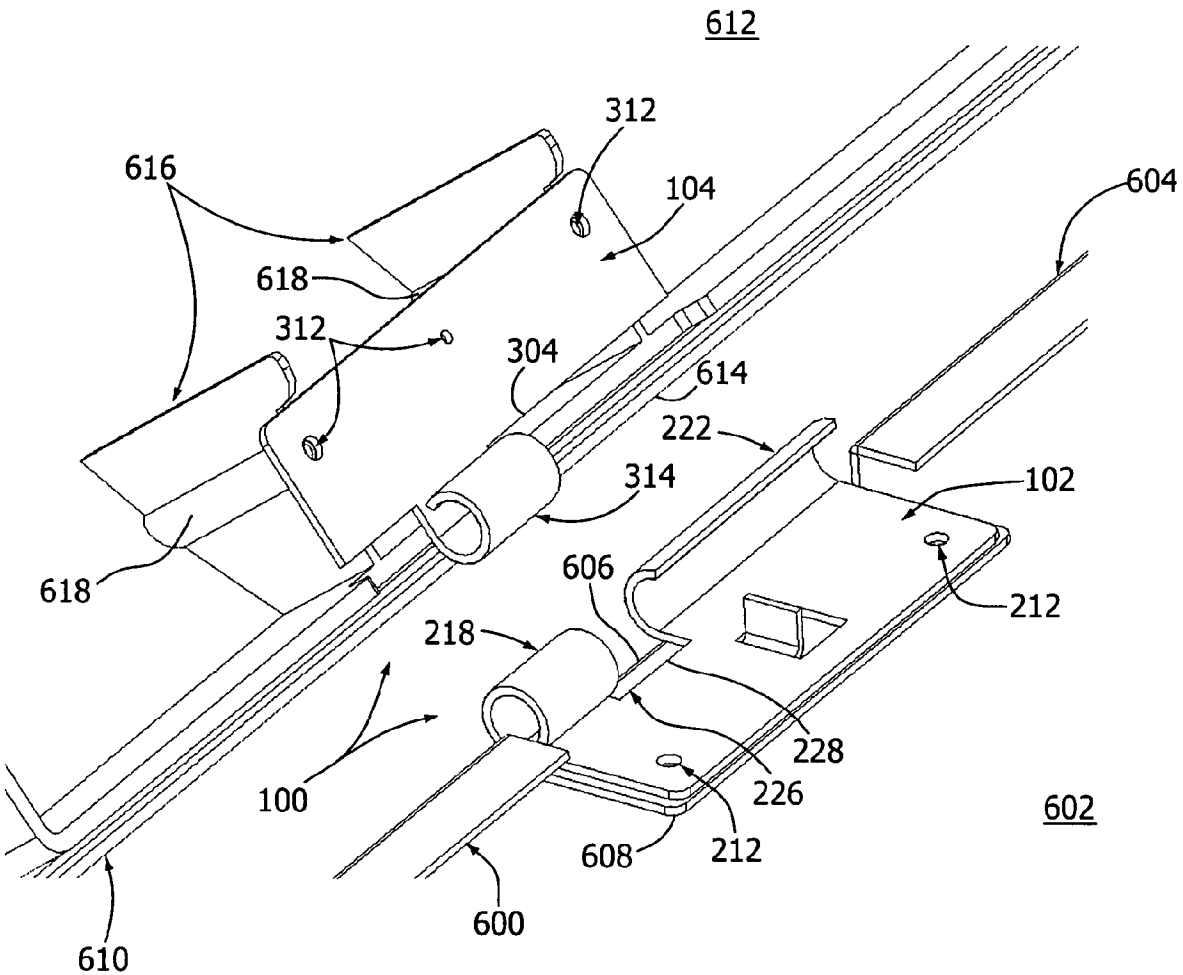
Figure 7:
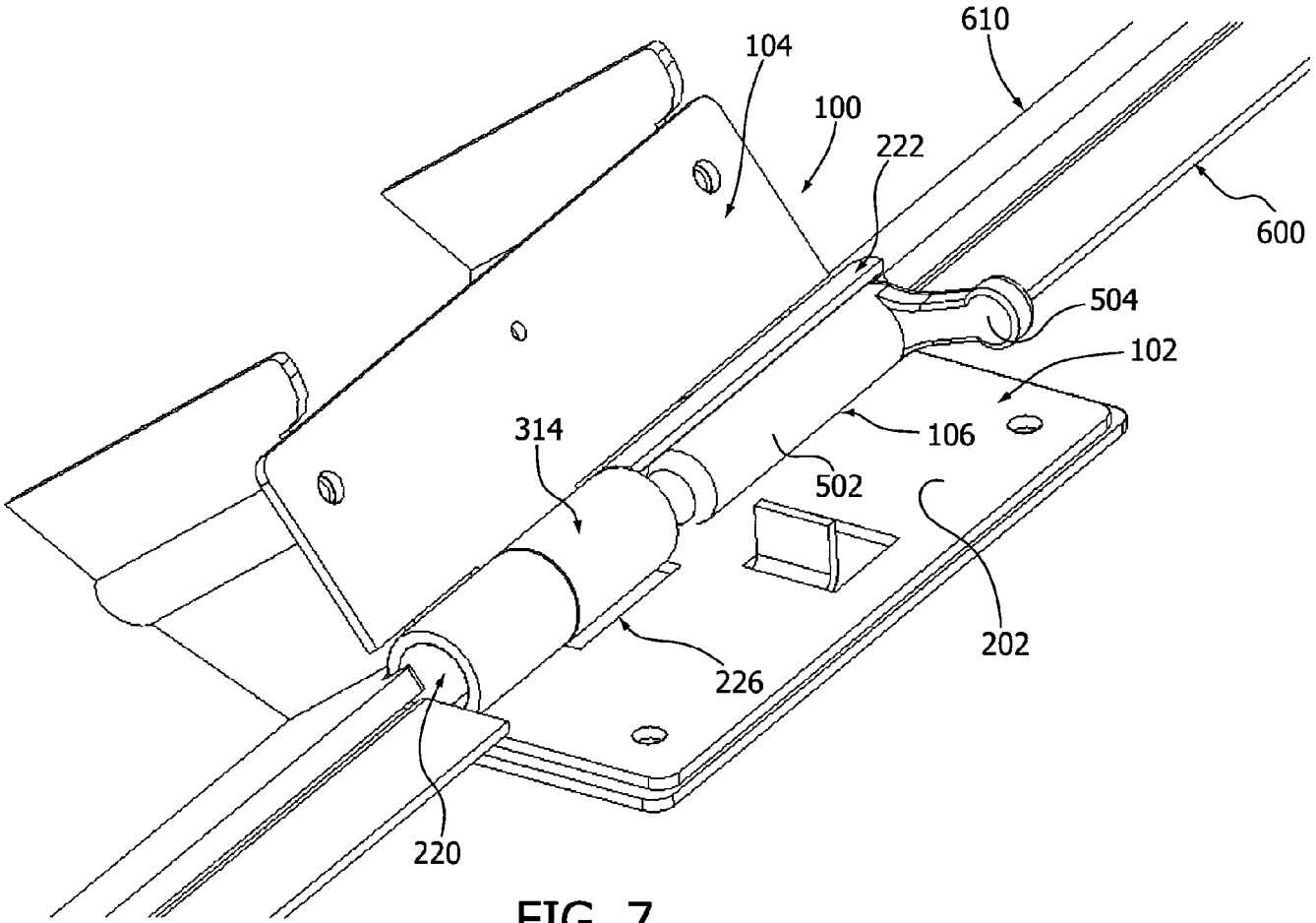
Figure 8:
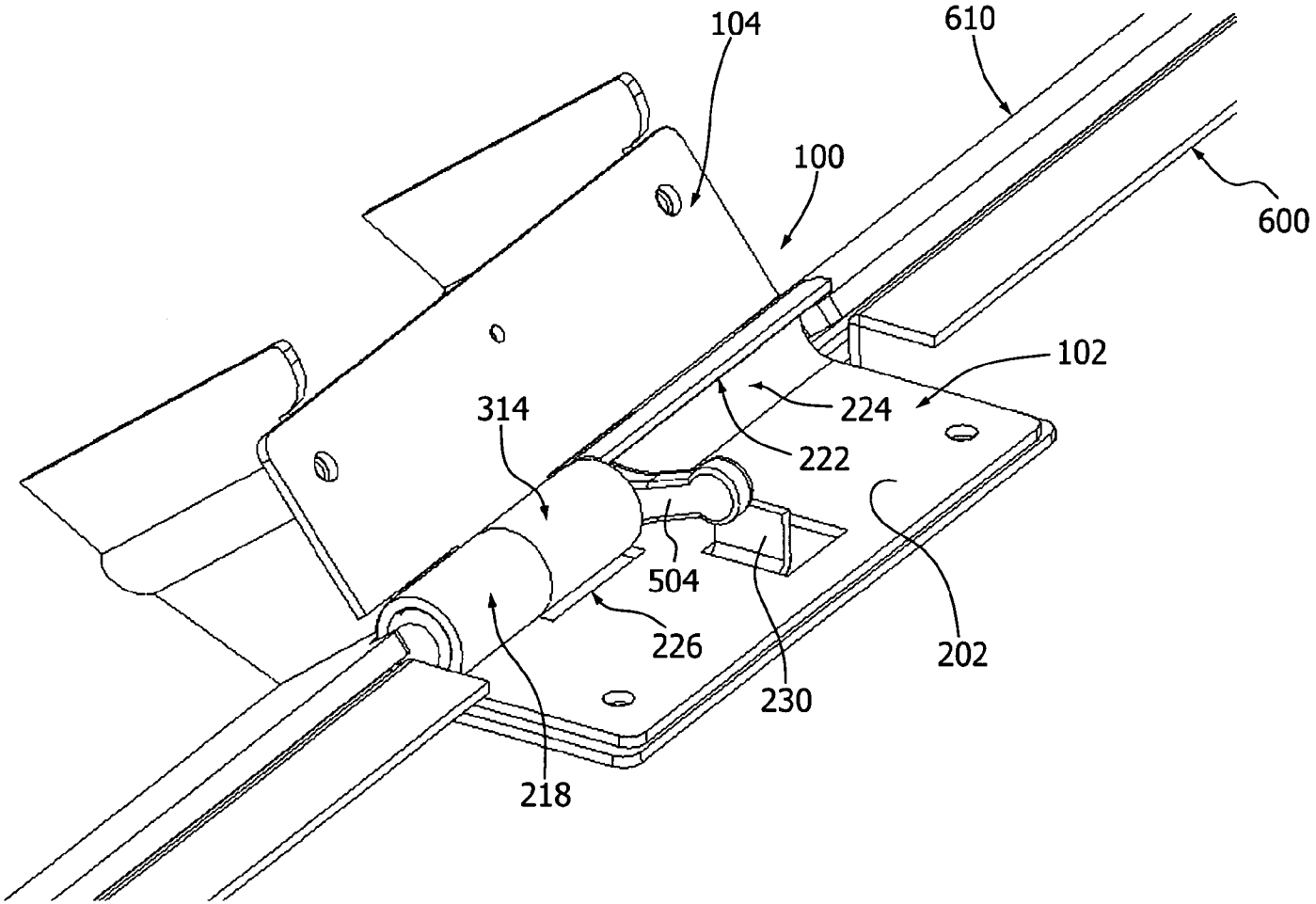

The embodiments described herein provide a low-cost hinge that is easier to assemble and disassemble. The hinge includes a first flange, a second flange, and a pin. The first flange may be mounted on a container using a pair of screws, and the second flange may be mounted on a cover using a locator pin and a pair of screws. The first flange and/or the second flange may be fabricated using steel, may be about 1-2 millimeters thick, and/or may be painted, and the pin may be fabricated from a plastic material. When sleeve segments of the first flange and the second flange are mated together, as shown in FIGS. 6-8 and described below, for example, the pin can be manually inserted into and/or manually withdrawn from the sleeve segments as desired to facilitate faster and easier assembly and/or disassembly of the cover and the container. With the pin inserted into the sleeve segments, the pin is substantially coincident with external faces of the cover and the container, and the pin is prevented from retracting by a tab of the first flange. Depending on the size and/or shape of the cover and the container, the hinge may be opened to an angle greater than 120°, such as, for example, between about 150° and 270° when the pin is inserted into the sleeve segments.

Figure 1:
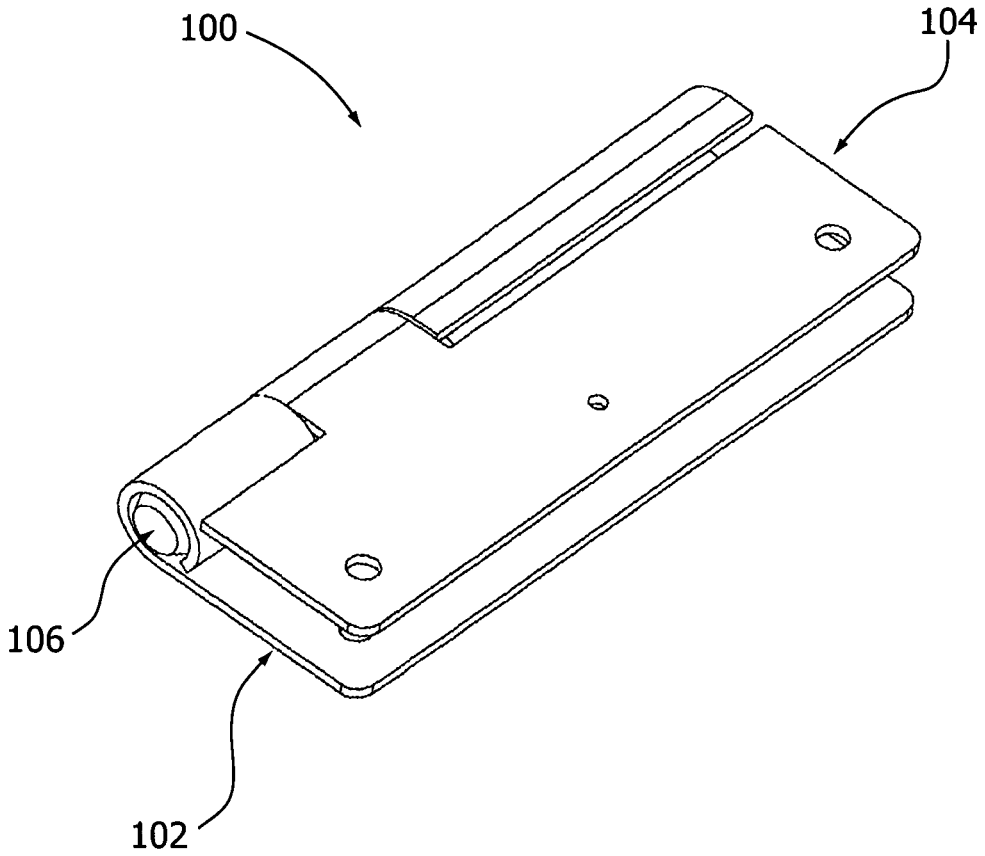
FIGS. 1-8 show exemplary embodiments of the systems and methods described herein.
Figure 2:
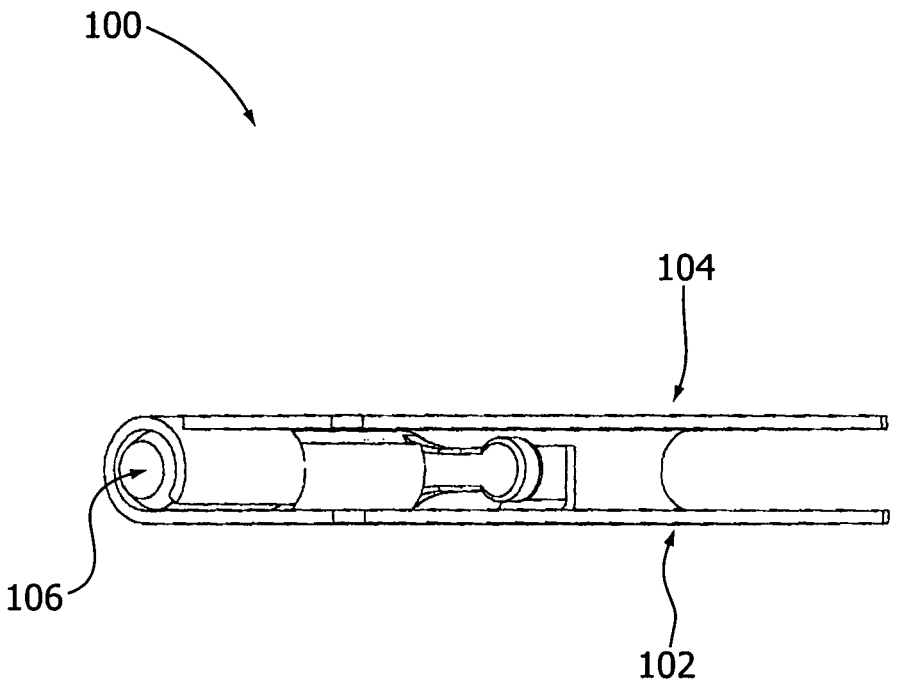

FIGS. 1 and 2 are perspective views of a hinge 100 in an assembled and closed configuration. In the exemplary embodiment, hinge 100 includes a first flange 102, a second flange 104, and a pin 106 for coupling first flange 102 to second flange 104 such that first flange 102 is pivotable relative to second flange 104 about pin 106, as described below.

Figure 3:
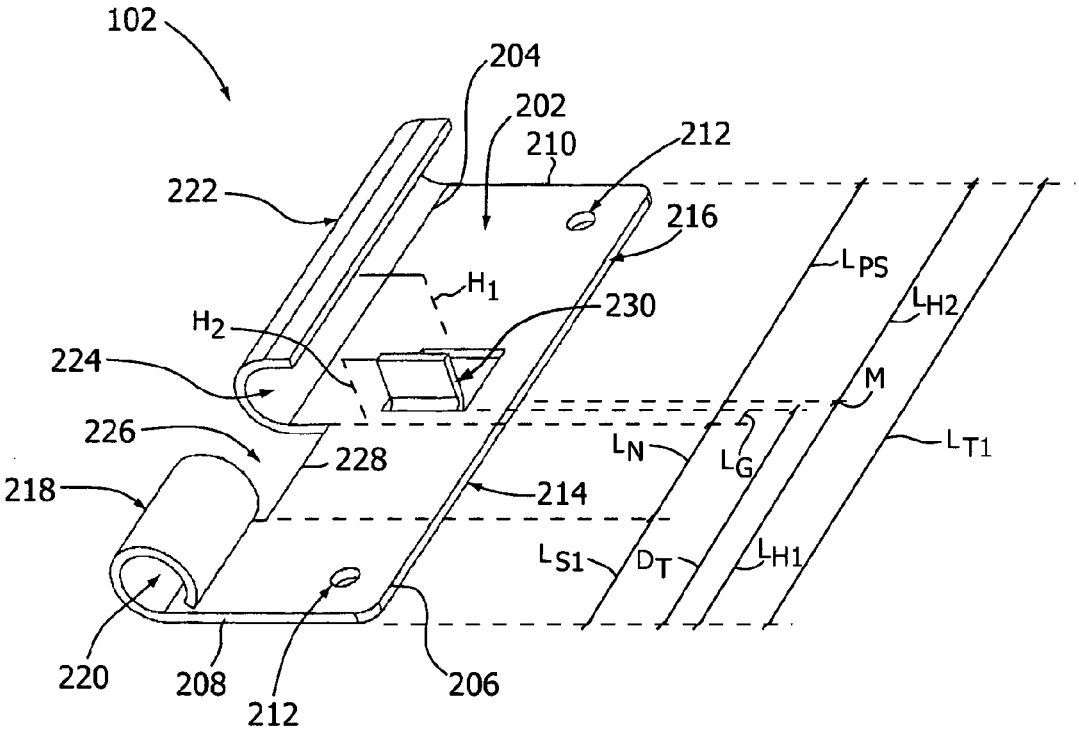

FIG. 3 is a perspective view of first flange 102. In the exemplary embodiment, first flange 102 has a generally rectangular first body 202 that includes a first side 204, a second side 206, a third side 208, a fourth side 210, and one or more fastener apertures 212. In alternative embodiments, first body 202 may have any suitable shape with any suitable number of sides and/or any suitable number of fastener apertures that facilitates enabling first flange 102 to function as described herein. In one embodiment, first side 204 and second side 206 have a substantially similar first total length $L_{T1}$, and first total length $L_{T1}$ has a midpoint M such that first flange 102 is segmented into a first half 214 having a first half length $L_{H1}$ and a second half 216 having a second half length $L_{H2}$. In other embodiments, first side 204 and second side 206 may have different lengths.

In the exemplary embodiment, first flange 102 also includes a first sleeve segment 218 that defines a first slot 220, a portioned sleeve segment 222 that defines a channel 224, and a notch 226 at least partially defined by an inner edge 228 that extends from first sleeve segment 218 to portioned sleeve segment 222. First sleeve segment 218 is substantially cylindrical, and portioned sleeve segment 222 is substantially semi-cylindrical. First sleeve segment 218 and portioned sleeve segment 222 extend from first body 202 and have a first height $H_1$ such that first slot 220 and channel 224 are substantially aligned with one another. First sleeve segment 218 has a first segment length $L_{S1}$ from third side 208, notch 226 has a notch length $L_N$ from first sleeve segment 218, and portioned sleeve segment 222 has a portioned sleeve segment length $L_{PS}$ from notch 226 to fourth side 210. The sum of first segment length $L_{S1}$, notch length $L_N$, and portioned sleeve segment length $L_{PS}$ is substantially equal to first total length $L_{T1}$, and the sum of first segment length $L_{S1}$ and notch length $L_N$ is less than first half length $L_{H1}$ such that portioned sleeve segment length $L_{PS}$ is greater than second half length $L_{H2}$. In other embodiments, first sleeve segment 218 and/or portioned sleeve segment 222 may be any suitable shape that facilitates enabling first flange 102 to function as described herein (e.g., portioned sleeve segment 222 may be less than semi-cylindrical). Alternatively, first sleeve segment 218, portioned sleeve segment 222, and/or notch 226 may have any suitable lengths that facilitate enabling first flange 102 to function as described herein.

In the exemplary embodiment, first flange 102 also includes a tab 230 that projects from first body 202 to a second height $H_2$ that is less than first height $H_1$. In other embodiments, second height $H_2$ may be greater than or equal to first height $H_1$. In the exemplary embodiment, tab 230 is spaced a tab distance $D_T$ from third side 208. Tab distance $D_T$ is greater than the sum of first segment length $L_{S1}$ and notch length $L_N$ and is less than first half length $L_{H1}$ such that tab 230 is located within first half 214. Thus, portioned sleeve segment 222 extends from fourth side 210 beyond tab 230 to define a gap length $L_G$ that is equal to tab distance $D_T$ minus the sum of first segment length $L_{S1}$ and notch length $L_N$. In alternative embodiments, tab distance $D_T$ may be any suitable distance that facilitates enabling first flange 102 to function as described herein. In the exemplary embodiment, first sleeve segment 218, portioned sleeve segment 222, and tab 230 are integrally formed together (i.e., formed from a single, continuous, and unjointed material) with first body 202. In other embodiments, first sleeve segment 218, portioned sleeve segment 222, and/or tab 230 may be formed separately from and coupled to first body 202 using any suitable fastener (e.g., a weld).

Figure 4:
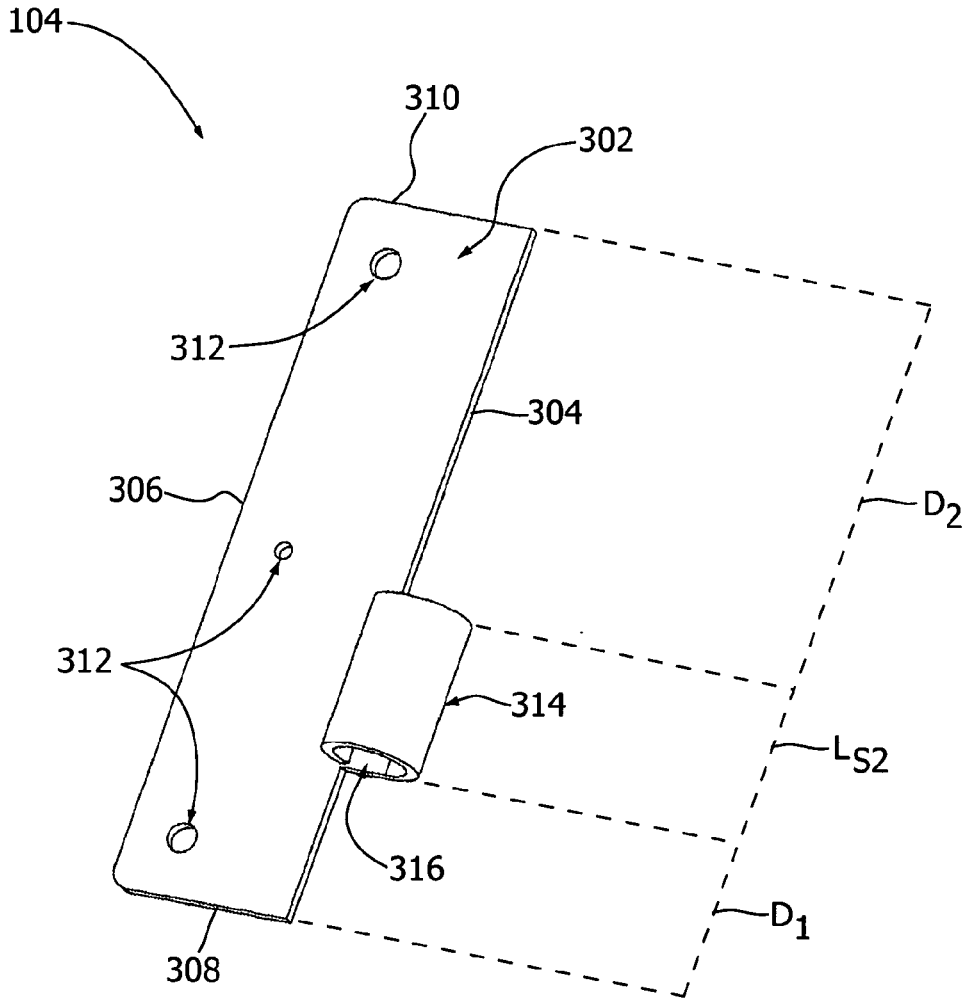

FIG. 4 is a perspective view of second flange 104. In the exemplary embodiment, second flange 104 has a generally rectangular second body 302 that includes a first side 304, a second side 306, a third side 308, a fourth side 310, and a plurality of fastener apertures 312. In alternative embodiments, second body 302 may have any suitable shape, any suitable number of sides, and/or any suitable number of fastener apertures that facilitates enabling second flange 104 to function as described herein. In the exemplary embodiment, second flange 104 also includes a second sleeve segment 314 that extends from first side 304 and defines a second slot 316. In the exemplary embodiment, second sleeve segment 314 is substantially cylindrical (e.g., second sleeve segment 314 and first sleeve segment 218 are similarly shaped). In other embodiments, second sleeve segment 314 may have any suitable shape. In the exemplary embodiment, second sleeve segment 314 is spaced a first distance $D_1$ from third side 308 and a second distance $D_2$ from fourth side 310. Second sleeve segment 314 has a second segment length $L_{S2}$. First segment length $L_{S1}$ is substantially equal to first distance $D_1$, second segment length $L_{S2}$ is substantially equal to notch length $L_N$, and portioned sleeve segment length $L_{PS}$ is substantially equal to second distance $D_2$ to facilitate mating second flange 104 with first flange 102, as described below. In other embodiments, second sleeve segment 314 may have any suitable length and may have any suitable location relative to second body 302 that facilitates enabling second flange 104 to function as described herein.

Figure 5:
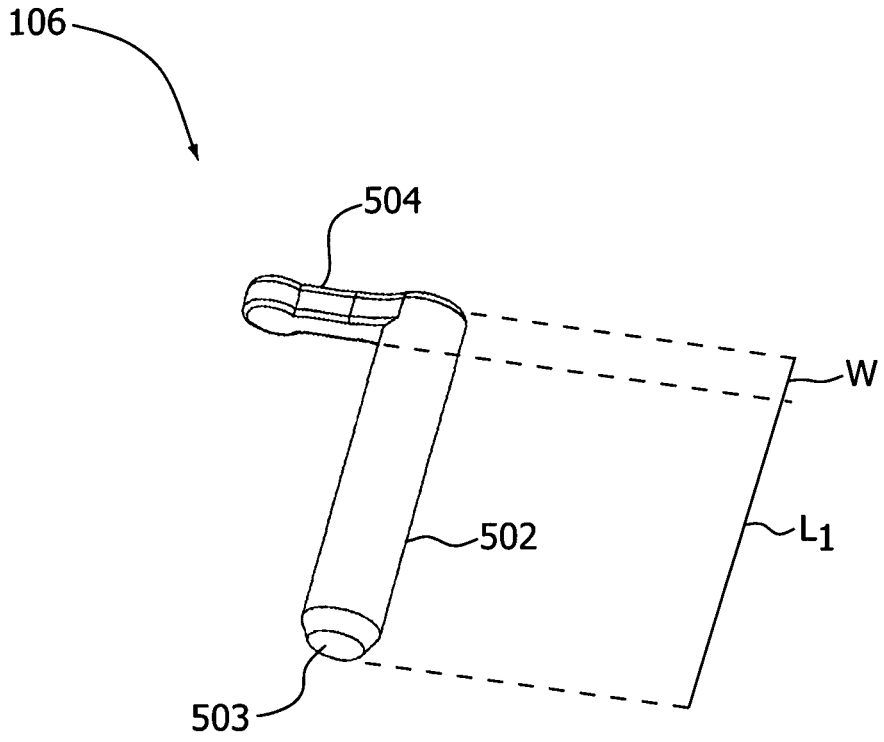

FIG. 5 is a perspective view of pin 106. In the exemplary embodiment, pin 106 includes a generally cylindrical insert 502 that extends from a tip 503 to a handle 504. Handle 504 extends substantially perpendicularly from insert 502 and has a handle width W that is less than gap length $L_G$, and insert 502 has an insert length $L_1$ from tip 503 to handle 504 such that insert length $L_1$ is substantially the same as the sum of first segment length $L_{S1}$ and second segment length $L_{S2}$. In some embodiments, handle width W may be substantially the same as gap length $L_G$. In other embodiments, insert 502 may have any suitable shape, handle 504 may have any suitable width, insert 502 may have any suitable length, and/or handle 504 may extend from insert 502 in any suitable direction that facilitates enabling pin 106 to function as described herein.

FIG. 6 is a perspective view of hinge 100 in an open configuration during a first or initial stage of assembly. In the exemplary embodiment, first flange 102 is coupled to a container 600 that defines a storage space 602. Container 600 includes a side wall 604, a container edge 606, and a shelf 608 extending into storage space 602 from side wall 604. First flange 102 is seated on and fastened to shelf 608 using any suitable fasteners (e.g., screws, nails, or bolts) inserted through fastener apertures 212 and into shelf 608 such that inner edge 228 of notch 226 is spaced apart from container edge 606 and such that first sleeve segment 218 and portioned sleeve segment 222 extend beyond container edge 606. In the exemplary embodiment, second flange 104 is coupled to a cover 610 that includes an underside 612, a cover edge 614, and a plurality of ribs 616 extending from underside 612 proximate cover edge 614 to define a plurality of bosses 618. Second flange 104 is fastened to ribs 616 using fasteners (e.g., screws) inserted through fastener apertures 312 and into bosses 618 such that first side 304 is spaced apart from cover edge 614 and such that second sleeve segment 314 extends beyond cover edge 614. In alternative embodiments, first flange 102 and/or second flange 104 may be coupled to container 600 and/or cover 610, respectively, in any suitable manner that facilitates enabling first flange 102 and/or second flange 104 to function as described herein.

FIG. 7 is a perspective view of hinge 100 in an open configuration during a second stage of assembly. In the exemplary embodiment, after first flange 102 is coupled to container 600 and second flange 104 is coupled to cover 610, as described above, second sleeve segment 314 is inserted into first notch 226 such that first slot 220, second slot 316, and channel 224 are substantially aligned. After first slot 220, second slot 316, and channel 224 are substantially aligned, pin 106 is inserted into channel 224 such that insert 502 is seated against portioned sleeve segment 222 and such that handle 504 can be oriented at an oblique angle relative to first body 202.

FIG. 8 is a perspective view of hinge 100 in an open configuration during a third stage of assembly. In the exemplary embodiment, after first slot 220, second slot 316, and channel 224 are substantially aligned and after insert 502 is positioned within channel 224, insert 502 is inserted into first slot 220 and second slot 316 such that handle 504 passes over tab 230 (i.e., above second height $H_2$) when handle 504 is at an oblique angle relative to first body 202 and such that handle 504 contacts second sleeve segment 314. When insert 502 is inserted into first slot 220 and second slot 316, handle 504 can be pivoted toward first body 202 and into a resting position, as shown in FIG. 2. Because handle width W is less than gap length $L_G$, handle 504 is sized to fit within gap length $L_G$ such that tab 230 prevents or limits retraction of pin 106 from first slot 220 and second slot 316.

In the exemplary embodiment, when handle 504 is in the resting position (shown in FIG. 2), hinge 100 is fully assembled, and cover 610 is pivotable relative to container 600 (i.e., hinge 100 is adjustable between the open position (shown in FIG. 8) and the closed position (shown in FIGS. 1 and 2)). In the exemplary embodiment, second flange 104 is at an angle of about 120° or greater relative to first flange 102 when hinge 100 is in the open position. In other embodiments, second flange 104 may be at an angle from about 150° to 270° relative to first flange 102 when hinge 100 is in the open position. In alternative embodiments, second flange 104 may be at any suitable angle relative to first flange 102 when hinge 100 is in the open position.

In the exemplary embodiment, when hinge 100 is in the closed position, tab 230 does not contact (i.e., is spaced apart from) second body 302 (as shown in FIG. 2) due, at least in part, to the fact that second height $H_2$ is less than first height $H_1$. As such, tab 230 and handle 504 do not prevent first flange 102 and second flange 104 from being pivoted into the closed position (i.e., tab 230 and handle 504 do not prevent cover 610 from completely closing container 600). To disassemble hinge 100, cover 610 is pivoted away from container 600 such that hinge 100 is again in the open position (as shown in FIG. 8). With hinge 100 in the open position, handle 504 is pivoted to an oblique angle relative to first body 202 to facilitate retracting pin 106 from first slot 220 and second slot 316 such that handle 504 passes over tab 230. With pin 106 retracted from first slot 220 and second slot 316, pin 106 is removable from channel 224, and second sleeve segment 314 is removable from notch 226 to facilitate separating cover 610 from container 600 (i.e., to facilitate easier maintenance and/or replacement of cover 610, container 600, and/or hinge 100). In the exemplary embodiment, container 600 and/or cover 610 are fireproof (e.g., container 600 and cover 610 are components of a fire panel). However, those skilled in the art will understand that container 600 and/or cover 610 can be components of any suitable assembly that incorporates hinges to facilitate coupling objects together, such as, for example, an intrusion panel, a personal laptop case, or a door/wall arrangement.

The methods and systems described herein facilitate providing a hinge that is more easily assembled and/or disassembled, thereby decreasing a time required to assemble and/or disassemble objects coupled together using the hinge. More specifically, the methods and systems described herein facilitate reducing a time and/or a cost associated with replacement and/or maintenance of hinged objects and/or the hinge.

Exemplary embodiments of a hinge and a method for assembling the hinge are described above in detail. The hinge and the methods for assembling the hinge are not limited to the specific embodiments described herein, but rather, components of the hinge and/or steps of the methods may be utilized independently and separately from other components and/or steps described herein. For example, the methods may also be used in combination with other hinge systems and methods, and are not limited to practice with only the container systems and methods as described herein. Rather, the exemplary embodiment can be implemented and utilized in connection with many other hinge applications.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A method for assembling a hinge, said method comprising:

mating a first flange including a first sleeve segment and a portioned sleeve segment with a second flange including a second sleeve segment such that the first sleeve segment, the second sleeve segment, and the portioned sleeve segment are substantially aligned; and removably inserting a pin into the first sleeve segment and the second sleeve segment;

wherein the first flange includes a first body and a tab projecting from the first body, said removably inserting a pin into the first sleeve segment and the second sleeve segment comprising positioning the pin such that the tab prevents retraction of the pin from the first sleeve segment and the second sleeve segment.

2. A method in accordance with claim 1, further comprising forming the portioned sleeve segment with a substantially semi-cylindrical shape.

3. A method in accordance with claim 1, further comprising forming a notch in the first flange between the first sleeve segment and the portioned sleeve segment, the notch sized to receive the second sleeve segment.

4. A method in accordance with claim 1, wherein said removably inserting a pin into the first sleeve segment and the second sleeve segment comprises forming the pin with an insert and a handle extending from the insert, the handle configured to facilitate insertion of the insert into the first sleeve segment and the second sleeve segment.

5. A method in accordance with claim 1, wherein the first sleeve segment has a first height from the first body and the tab has a second height from the first body, the second height less than the first height, said method further comprising closing the hinge such that the tab is spaced apart from the second flange.

6. A hinge, comprising:

a first flange comprising a first sleeve segment and a portioned sleeve segment;

a second flange comprising a second sleeve segment, said second flange configured to mate with said first flange such that said first sleeve segment, said second sleeve segment, and said portioned sleeve segment are substantially aligned; and a pin configured to be removably inserted into said first sleeve segment and said second sleeve segment;

wherein said first flange comprises a first body and a tab projecting from said first body, said tab configured to prevent retraction of said pin from said first sleeve segment and said second sleeve segment.

7. A hinge in accordance with claim 6, wherein said portioned sleeve segment is substantially semi-cylindrical.

8. A hinge in accordance with claim 6, wherein said first flange comprises a notch defined between said first sleeve segment and said portioned sleeve segment, said notch sized to receive said second sleeve segment.

9. A hinge in accordance with claim 6, wherein said pin comprises an insert and a handle extending from said insert, said handle configured to facilitate insertion of said insert into said first sleeve segment and said second sleeve segment.

10. A hinge in accordance with claim 6, wherein said first sleeve segment has a first height from said first body and said tab has a second height from said first body, the second height less than the first height.

11. A container assembly, comprising:

a container; a cover for said container; and a hinge pivotably coupling said cover to said container, said hinge comprising:

a first flange fastened to said container, said first flange comprising a first sleeve segment and a portioned sleeve segment;

a second flange fastened to said cover, said second flange comprising a second sleeve segment, said second flange configured to mate with said first flange such that said first sleeve segment, said second sleeve segment, and said portioned sleeve segment are substantially aligned; and a pin configured to be removably inserted into said first sleeve segment and said second sleeve segment;

wherein said first flange comprises a first body and a tab projecting from said first body, said tab configured to prevent retraction of said pin from said first sleeve segment and said second sleeve segment.

12. A container assembly in accordance with claim 11, wherein said portioned sleeve segment is substantially semi-cylindrical.

13. A container assembly in accordance with claim 11, wherein said first flange comprises a notch defined between said first sleeve segment and said portioned sleeve segment, said notch sized to receive said second sleeve segment.

14. A container assembly in accordance with claim 11, wherein said pin comprises an insert and a handle extending from said insert, said handle configured to facilitate insertion of said insert into said first sleeve segment and said second sleeve segment.

15. A container assembly in accordance with claim 11, wherein said first sleeve segment has a first height from said first body and said tab has a second height from said first body, the second height less than the first height.

16. A container assembly in accordance with claim 11, wherein said container comprises a wall and a shelf extending from said wall, said first flange fastened to said shelf.

17. A container assembly in accordance claim 11, wherein said cover comprises an underside and a plurality of ribs extending from said underside, said second flange fastened to said plurality of ribs.

18. A container assembly in accordance with claim 11, wherein said container assembly is a fire panel.

* * * * *